US008574085B1

(12) United States Patent
Jackson

(10) Patent No.: US 8,574,085 B1
(45) Date of Patent: Nov. 5, 2013

(54) ARTIFICIAL CAVE OBSTACLE COURSE WITH ELECTRONIC SENSING

(76) Inventor: David Alexander Jackson, Manitou Springs, CO (US)

( * ) Notice: Subject to any disclaimer, the term of this patent is extended or adjusted under 35 U.S.C. 154(b) by 291 days.

(21) Appl. No.: 13/068,518

(22) Filed: May 13, 2011

Related U.S. Application Data

(60) Provisional application No. 61/395,482, filed on May 14, 2010.

(51) Int. Cl.
*A63J 11/00* (2006.01)
*A63B 9/00* (2006.01)

(52) U.S. Cl.
USPC ..... 472/62; 472/136

(58) Field of Classification Search
USPC ..... 472/59, 61, 62, 136; 482/35, 36; 273/440, 445, 459, 460
See application file for complete search history.

(56) References Cited

U.S. PATENT DOCUMENTS

| | | | | | |
|---|---|---|---|---|---|
| 4,546,965 | A * | 10/1985 | Baxter et al. | ..... | 482/35 |
| 5,393,074 | A * | 2/1995 | Bear et al. | ..... | 273/440 |
| 6,095,927 | A * | 8/2000 | Malone | ..... | 472/62 |
| 6,675,538 | B2 * | 1/2004 | Candio | ..... | 52/65 |
| 8,038,589 | B2 * | 10/2011 | Sperry | ..... | 482/148 |

* cited by examiner

*Primary Examiner* — Kien Nguyen

(57) ABSTRACT

An obstacle course has the appearance of a natural cave environment. The course may include a plurality of interconnected, hollow, three-dimensional shapes through which human users can pass. The shapes may be modular to allow various different configurations of the course. The shapes may contain models of cave formations (speleothems), with which the users are expected to avoid contact and close proximity. Electronic sensing may be provided for monitoring any contact and proximity of the users to the speleothems, and additional electronic circuitry may be provided to present feedback to the users regarding their performance in the course.

20 Claims, 13 Drawing Sheets

ARTIFICIAL CAVE OBSTACLE COURSE WITH ELECTRONIC SENSING

CROSS-REFERENCE TO RELATED APPLICATIONS

This application claims the benefit of Provisional Application 61/395,482 filed on May 14, 2010.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

Obstacle courses are commonly used in education and training to challenge participants physically and mentally. They can also be used to teach participants about a particular environment without actually placing them in that environment. For example, obstacle courses that mimic a city struck by a natural disaster currently exist, and are used to train search and rescue personnel in the safe and effective rescue of citizens. Obstacle courses are also used to mimic the confined and tortuous passages of caves for search and rescue training and other educational purposes. Such obstacle courses generally mimic cave environments in an ad hoc manner using readily available materials such as plastic flagging tape, picnic tables, or playground equipment. However, in addition to containing confined and tortuous passages, real cave environments contain mineral deposits, often called cave formations or speleothems. Many types of formations exist, and common examples are stalactites and stalagmites. Commonly accepted wisdom among cave researchers, enthusiasts, and rescue personnel indicates that physical contact with cave formations should be avoided for two primary reasons: contact can damage the formations and/or halt their mineral growth; contact can cause injury, such as abrasion, puncture wounds, or splinter-type wounds. Despite the fact that real caves contain a plethora of types of cave formations, currently available cave obstacle courses do not model the appearance of caves, do not contain models of cave formations, and do not provide feedback to the user about how successfully the user has avoided contact with the cave formations. Thus, there is room for improvement in cave obstacle courses.

BRIEF SUMMARY OF THE INVENTION

This invention provides an obstacle course designed to look like a natural cave environment. The obstacle course may contain artificial cave formations (speleothems), as well as electro-mechanical sensors for the detection of human interaction with the artificial formations. Further, this invention provides electronic equipment for interfacing with the electro-mechanical sensors and with the users and operators of the obstacle course.

DETAILED DESCRIPTION OF THE INVENTION

Figure 1:
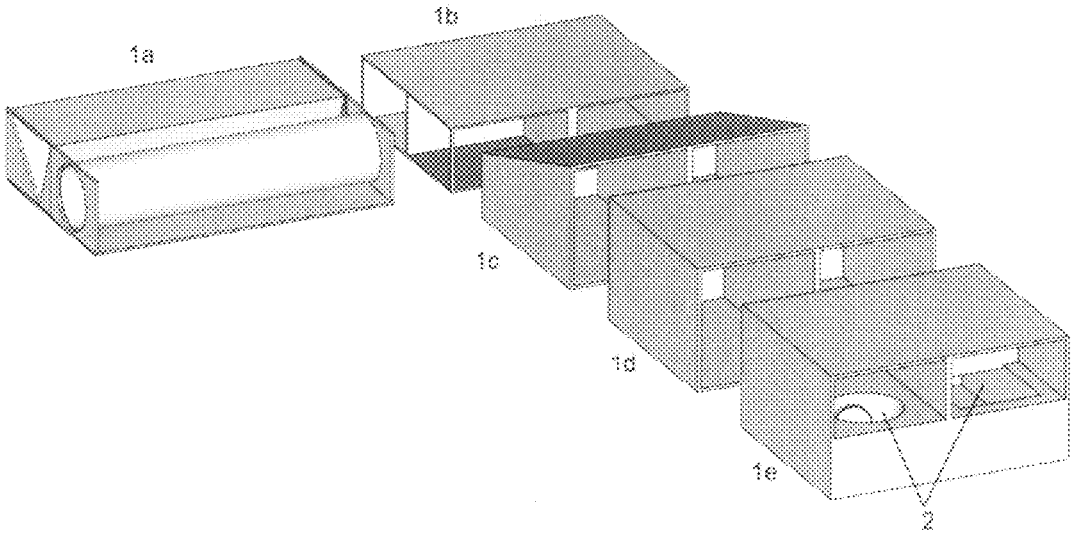
FIG. 1 is a simplified perspective (or isometric) view of an illustrative embodiment of reconfigurable units for an obstacle course in accordance with certain possible aspects of the invention.
Figure 2:
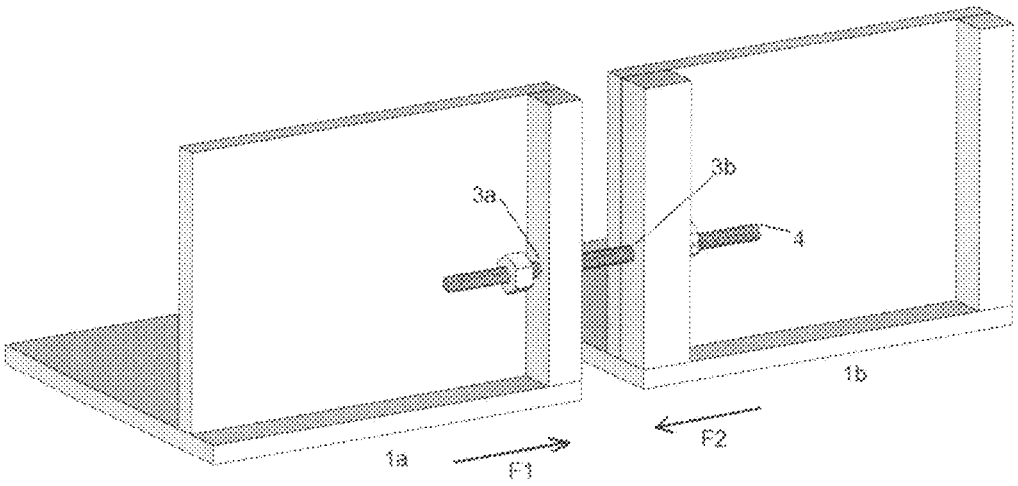
FIG. 2 is a simplified perspective (or isometric) view of an example of linkage between units in accordance with certain possible aspects of the invention.
Figure 3:
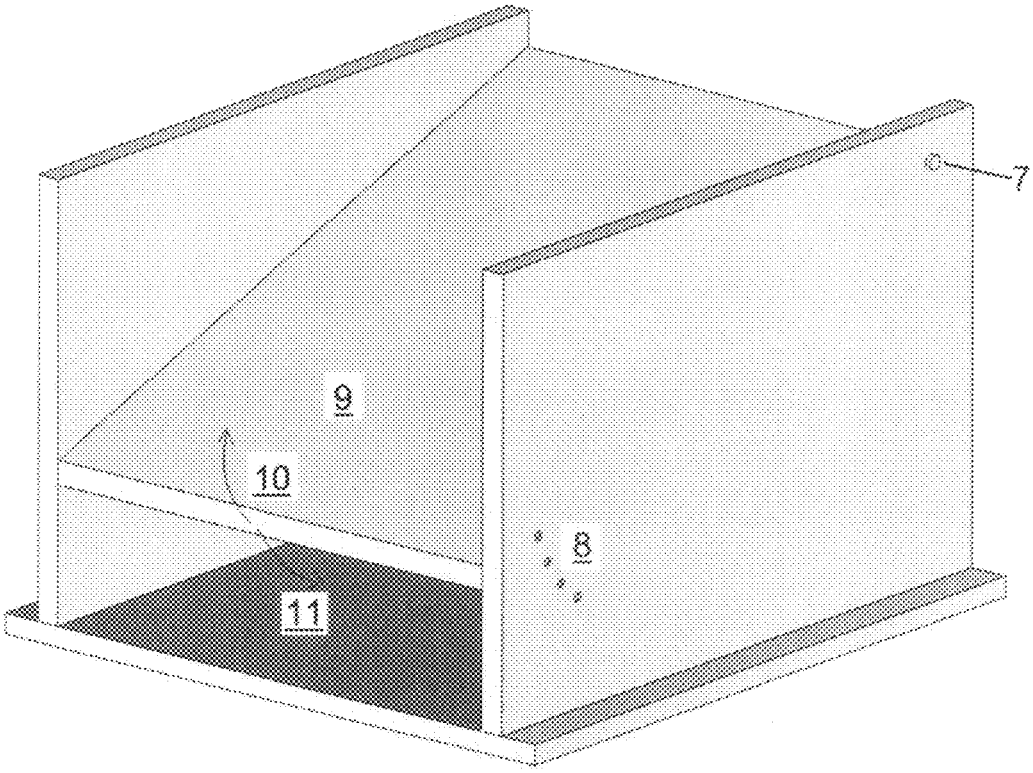
FIG. 3 is a simplified perspective (or isometric) view of an illustrative embodiment of a unit with a hinge point for ceiling angle adjustment in accordance with certain possible aspects of the invention.
Figure 4:
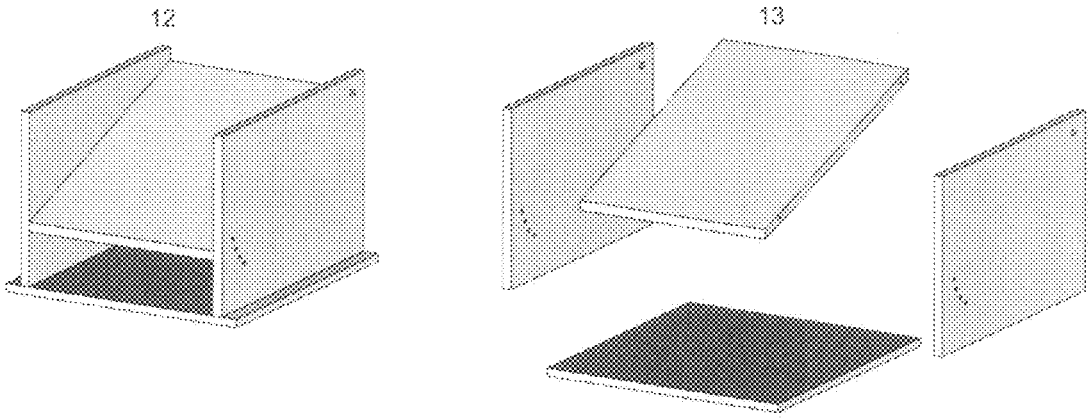
FIG. 4 is a pair of simplified perspective (or isometric) views of disassembly of an illustrative embodiment of a unit in accordance with certain possible aspects of the invention.

FIG. 1 shows an illustrative embodiment of the structure of a cave obstacle course in accordance with certain possible aspects of the invention. In this embodiment, the cave obstacle course includes a series of hollow, three-dimensional shapes 1*a*-1*e*, such as, but not limited to, rectangular and triangular prisms and cylinders, connected to form a passage 2 through which one or more humans can move, either with or without various types of equipment. The three-dimensional shapes 1*a*-1*e*, referred to subsequently as units 1, can be modular and reconfigurable such that the order of the shapes can be changed to alter the obstacle course. The units 1 may have certain standard dimensions such as length or width to facilitate placing the units 1 in any number of different sequences. As shown in FIG. 2, the units 1*a,b* may have attachment points 3*a,b* to allow bolts or other fasteners 4 to link adjacent units for the purpose of providing structural stability and correct alignment. The units 1 are drawn together by equal and opposite forces F1 and F2 imposed by the fastener 4. Thus, although units 1 are shown somewhat spaced apart in FIG. 1 (e.g., to better show their interior construction), in actual use the various units are preferably secured immediately adjacent to one another to form one or more continuous passages 2 through the assembled cave obstacle course. Further, as shown in FIG. 3, various units 1 can contain hinge points 7 and other adjustments 8 to allow the size and shape of the unit to be changed, for example to allow the ceiling 9 to be moved along arcs 10 and 11. Also, as shown in FIG. 4, each unit 1 can be disassembled from state 12 to state 13 by the removal of bolts or other fasteners to allow the unit to occupy a smaller volume for transportation of the obstacle course. Alternatively, the obstacle course units can be permanently installed in a given location such as a building or vehicle, and the various units 1 permanently connected together.

The aforementioned obstacle course units are typically formed by some thickness of a suitable material, such as plywood, plastic, fiberglass or metal. This thickness of material (hereafter referred to as "wall") can be solid, or can contain voids or airspace for reduced weight.

Figure 5:
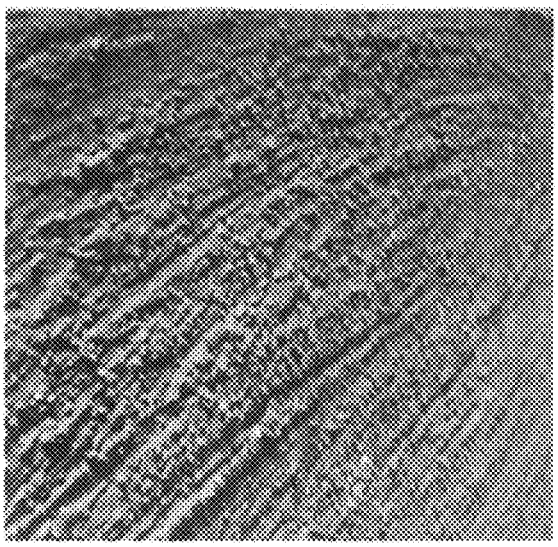
FIG. 5 is a simplified perspective (or isometric) view of an example of texture on an interior wall of the obstacle course in accordance with certain possible aspects of the invention.

The interior surfaces of the walls may be textured and/or colored to have the appearance of a cave passage. Such texture can be created using any suitable material, including, but not limited to, epoxy or other plastics, foam, silica sand, plaster or other wall-texture products. The coloration can be applied as part of, or over, the texture, and can be any suitable material, including, but not limited to, latex or oil-based paint, pigmented epoxy, or other plastic. The texture and color can be applied in a variety of sequences, including simultaneously. Further, the color and texture can be overlaid with a protective finish, such as transparent epoxy, varnish, or other coating. Additionally, the texture can be formed through the use of negative-image molds, such as those made of silicone rubber, and the texture may be an integral part of the wall (i.e. formed as part of the wall). See FIG. 5 for an illustration of the texture of the interior of the obstacle course. Additionally, the texture may be rigid, or it may be flexible to allow it to conform to the body of the user. For example, a rubber or foam floor, optionally covered by a material such as fabric, may be used to make the process of crawling through the obstacle course more comfortable for the users.

In addition to being textured, the interior of the obstacle course can contain irregularities of various sizes and shapes, such as artificial stones. Such objects can be made of any suitable material, such as wood, plastic, fiberglass, or metal. The objects may be fixed in place, or may be movable, in which case they may have a standard interface to the obstacle course walls to allow their locations to be interchanged. These objects may have texture similar to, or different from, the texture on the interior surface of the obstacle course.

The exterior surfaces of the walls can also be textured and/or colored to have any number of appearances, including that of stone, earth, or vegetation. The exterior surfaces may also be used to display text and images pertinent to the obstacle course, caves, etc.

Figure 6:
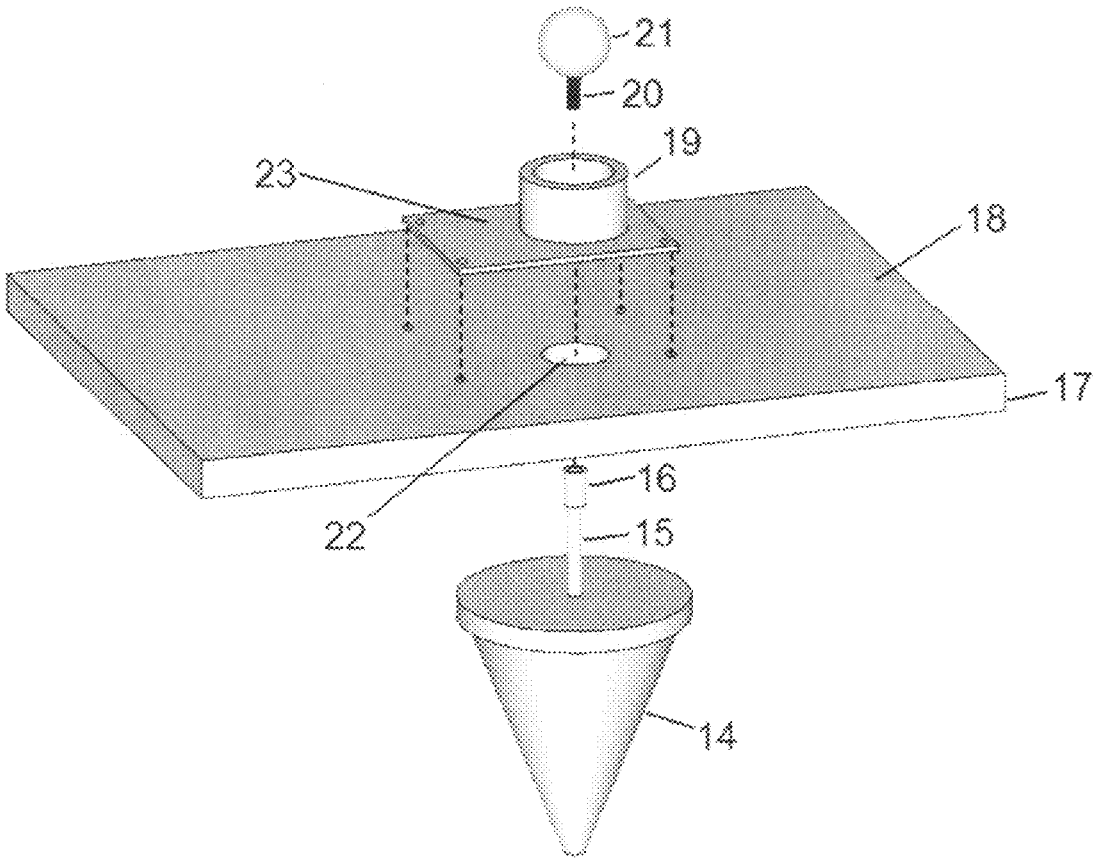
FIG. 6 is a simplified perspective (or isometric) view of an illustrative embodiment of sphere-and-socket mounting of an artificial cave formation in accordance with certain possible aspects of the invention.

The interior surfaces of the walls of the obstacle course can be fitted with any number of artificial cave formations. In some cases, these formations can be attached rigidly to the interior surface, while in other cases the formations can be attached in such a way as to allow movement of the formation in one or more dimensions. In one implementation, shown in FIG. 6, a formation 14 may be attached by a rod 15 to a sphere 21, located in a socket 19. Such a socket 19 allows the sphere 21 to rotate in place about three axes simultaneously, which in turn allows the formation 14 to move in three dimensions. The sphere 21 and socket 19 may be located on the outside surface 18 of the obstacle course wall 17, in which case the aforementioned rod 15 passes through hole 22 in the wall 17. In other implementations (not shown), the socket 19 may be located on the inside surface of the wall 17, or between the two wall surfaces (i.e. embedded in the wall 17). The aforementioned rod 15, used to connect the formation 14 and the sphere 21, may contain a mechanical linkage 16, 20 which allows the formation 14 to be separated from the sphere 21. This linkage 16, 20 can be of a standard form, thereby allowing any number of different formations 14 to be affixed to a given sphere 21. Such an implementation allows the sphere 21 and socket 19 to stay fixed in place, and simultaneously allows the formations 14 to be relocated. The socket 19 may be part of a fixture 23 with a standard interface to the wall 17, such that the socket 19/sphere 21 combinations can be relocated. In other implementations, formations 14 may be constrained to move linearly, or to swing in a single plane.

The aforementioned formations 14 can be made of a variety of materials, including plastic, metal, wood, and foam. In one implementation, a formation may be cast in plastic using a negative-image silicon rubber mold. The original (or "pattern") for the mold can be formed using a variety of materials, including modeling clays and waxes.

The formations may be wholly or partly modeled after any formations found in real caves, such as, but not limited to, stalactites, stalagmites, cave bacon, cave popcorn, helictites, aragonite, gypsum flowers, soda straws, rafts, shields, cave pearls, flowstone, boxwork, columns and spar. In addition to artificial formations, the obstacle course may contain models of various forms of flora and fauna found in caves such as insects, spiders, bats, rodents, lizards and other reptiles, salamanders and other amphibians, and plant roots. Further, the obstacle course can contain models of a variety of man-made objects, such as survey markers, environmental recording devices, paleontological artifacts and other objects that should not normally be touched. The obstacle course may even contain man-made objects that cave explorers normally would remove, such as trash, such that the users of the obstacle course can receive positive feedback (via electronic sensing) for removing or moving such objects.

Figure 7:
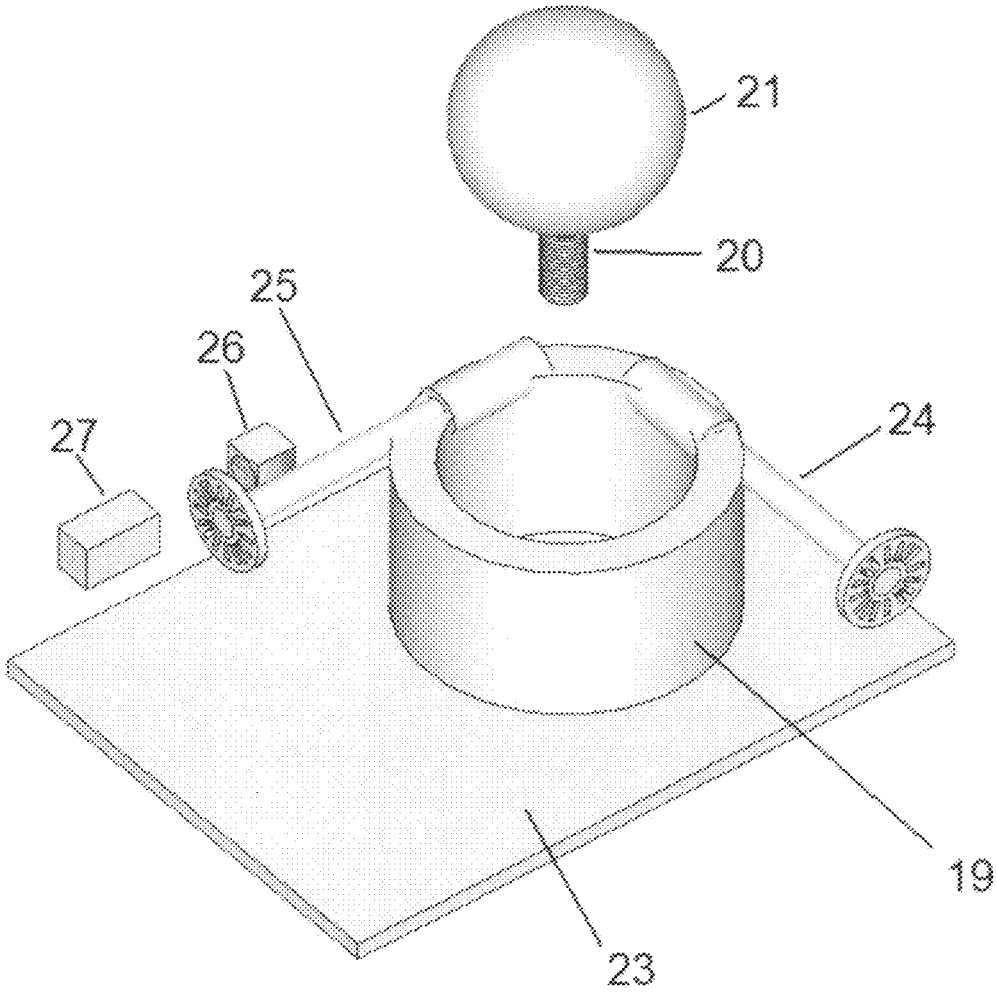
FIG. 7 is a simplified perspective (or isometric) view of an illustrative embodiment of apparatus for sensing motion of a formation with optical choppers in accordance with certain possible aspects of the invention.
Figure 8:
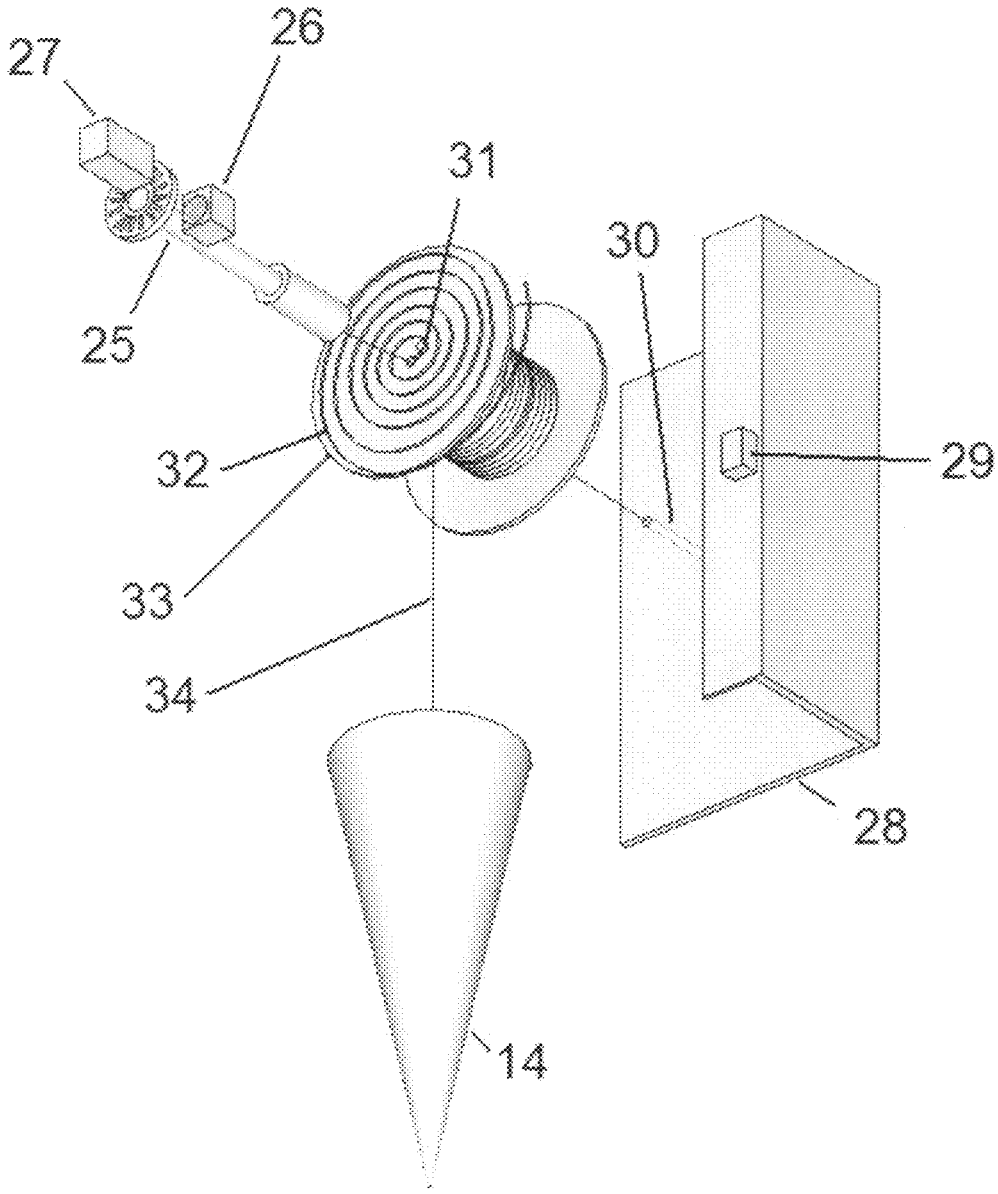
FIG. 8 is a simplified perspective (or isometric) view of an illustrative embodiment of an artificial formation mounted on a cord and spool, and sensed with an optical chopper in accordance with certain possible aspects of the invention.
Figure 9:
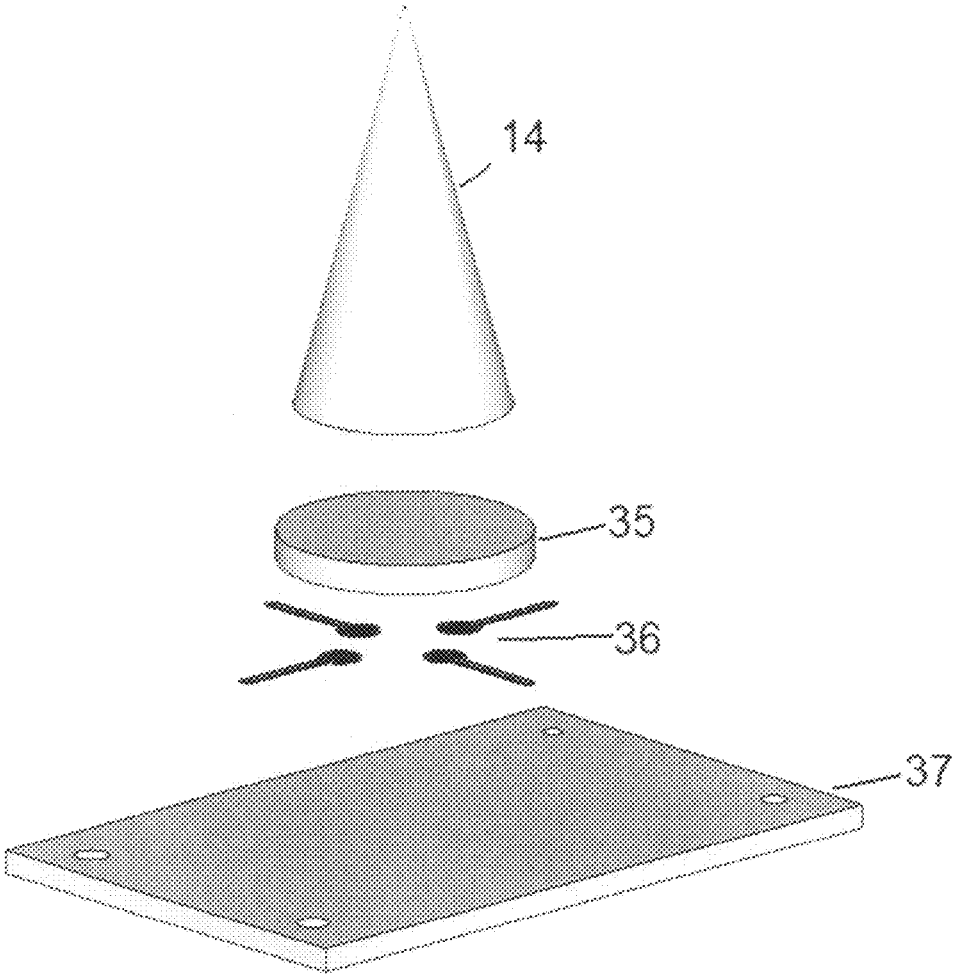
FIG. 9 is a simplified perspective (or isometric) view of an illustrative embodiment of an artificial formation sensed with pressure-sensitive elements in accordance with certain possible aspects of the invention.

In order to provide feedback to the users of the obstacle course, electronic and/or electro-mechanical sensors can be affixed to or embedded in the formations, or linked to the formations mechanically, or placed near the formations. In one implementation, shown in FIG. 7, the aforementioned sphere 21 is used to rotate two orthogonal optical choppers 24, 25 (commonly used in trackball computer mice, optical choppers either block or pass light depending upon their degree of rotation). As the sphere 21 rotates, one or both of the optical choppers 24, 25 rotate, and alternately interrupt and pass an infrared beam emanating from an infrared source 27 to an electronic infrared detector 26 (also referred to herein as a receiver or sensor). The detector 26 converts the information contained in the time-varying infrared beam into an electrical signal, which can then be processed to determine the degree and/or direction of motion of the formation. In another implementation, shown in FIG. 8, a formation 14 may be connected to a length of cord 34, the other end of which is wound around a spool 33 on an axle 30, and with tensioning spring 32 mounted on the spool 33 and retained by a spring retainer 29. As the formation 14 is displaced, the cord 34 is unwound from the spool 33, which is also connected to an optical chopper 25 with associated infrared source 27 and detector 26, or to an optical encoder, potentiometer or other rotary sensor. Rotational energy is thereby converted to electrical information. In another implementation (not shown), an accelerometer is placed on or in the formation such that force can be converted to a proportional electrical signal. In yet another implementation, shown in FIG. 9, one or more pressure-sensitive elements 36 are placed between the formation 14 and a fixed surface 37 (either directly to the interior of the wall or to a fixture that can be affixed to the interior of the wall). An elastic material 35 is used to distribute force evenly onto the pressure sensing elements 36, such that displacement of the formation 14 results in an alteration of the pressure on the pressure sensing elements 36, which in turn alters the electrical impedance of the elements 36. This impedance change can be converted to an electrical signal and processed. Switches can be substituted for the pressure-sensitive elements 36. Alternatively, strain gauges may be used to convert distortion of the shape of a semi-flexible formation 14 to electrical information. The aforementioned electro-mechanical sensing methods are just a few of the many methods that may be used to detect motion of, or force applied to, the formations.

Figure 10:
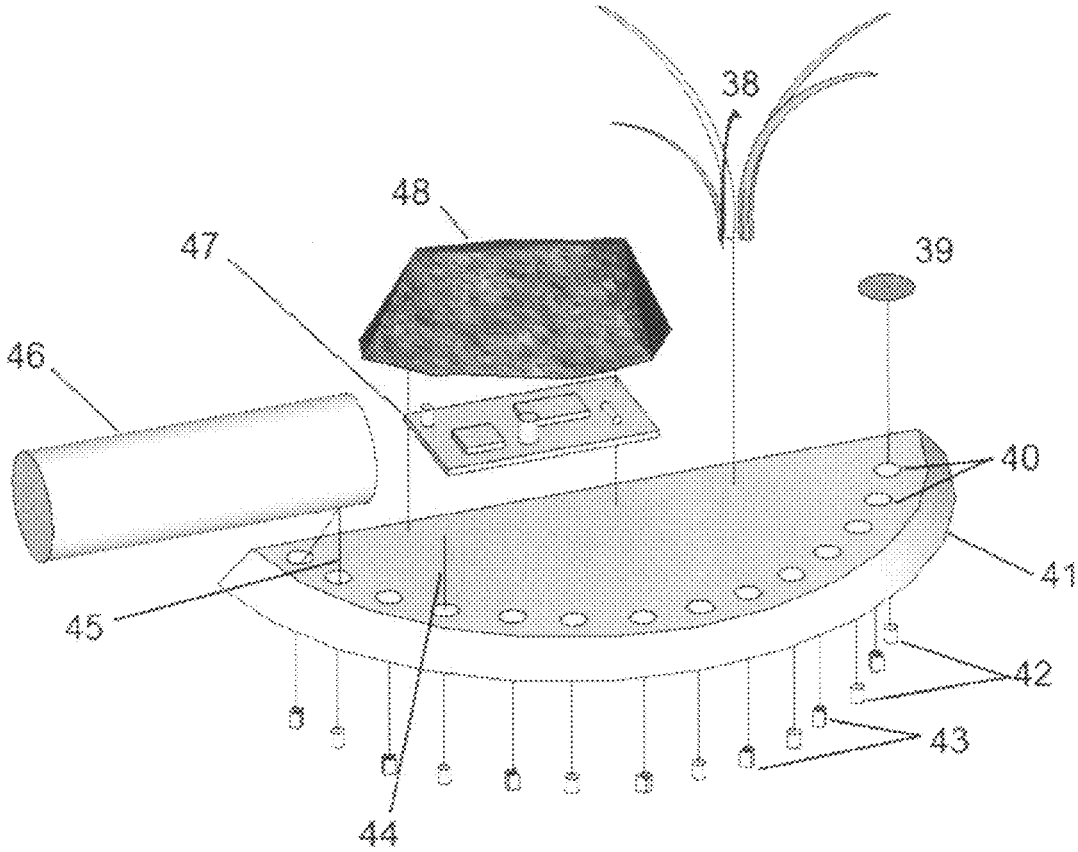
FIG. 10 is a simplified perspective (or isometric) view of an illustrative embodiment of optical reflection-based sensing of proximity of foreign objects to an artificial formation in accordance with certain possible aspects of the invention.

In addition to sensing the motion of formations, or the pressure applied to formations, it is advantageous in certain cases to detect the proximity of obstacle-course participants and their equipment to formations. For example, in real cave environments, certain formations are sufficiently fragile that commonly accepted wisdom dictates that humans and their equipment should maintain a safe distance from the formations. In this invention, a variety of proximity sensors may be used, including, but not limited to, optical, acoustic, radio-frequency, or capacitance-based sensors. Such sensors may be reflection-based or of break-beam type, and they may be mounted in, on, or near a formation. A reflection-based optical sensor implementation is shown in FIG. 10. In this implementation, an array of parallel infrared light beams 44 is generated by sources 42 around the formation 38 to be sensed. An array of detectors 43 is placed near the light sources 42 such that the presence of a foreign object 46 in the path of the light beams causes light to be reflected to the detectors. The detectors 43 output an electrical signal that is proportional to the intensity of the reflected light 45. The light sources 42 and detectors 43 are mounted in holes 40 and protected and enhanced by lenses 39. The associated electronic circuitry 47 is concealed inside of artificial stone 48 formed from a suitable material such as foam, plastic, or wood, which is then mounted to a base 41.

Figure 11:
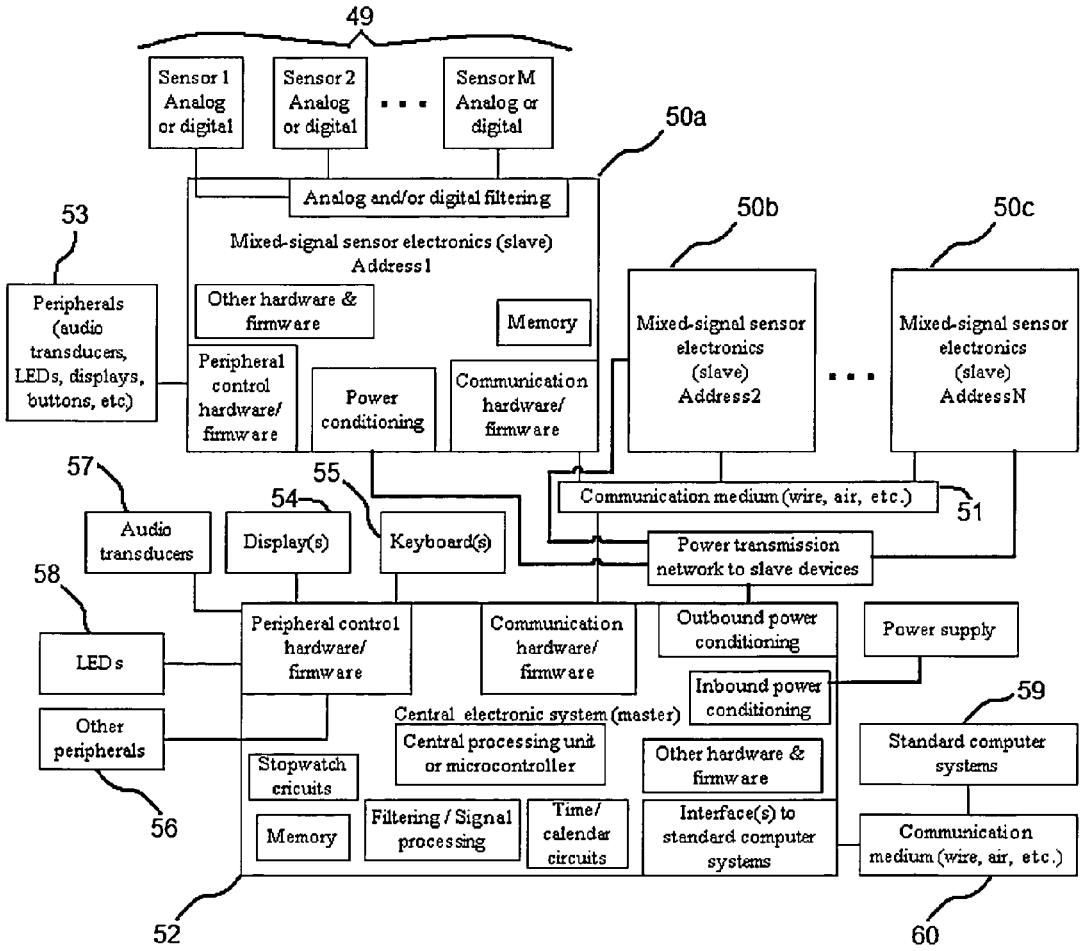
FIG. 11 is a simplified block diagram of an illustrative embodiment of electronic systems for the obstacle course in accordance with certain possible aspects of the invention.

All of the previously mentioned electro-mechanical sensors produce electrical signals that can be processed in order to provide the users and operators of the obstacle course with information about how successfully the users are navigating the obstacle course. This signal processing can be accomplished in a variety of ways, such as by fan-in to a single electronic system, or by several stages of processing. In the staged approach, shown in FIG. 11, the signals from the sensors 49 associated with a given formation are processed by a digital or mixed-signal circuit 50*a* containing a microcontroller (slave microcontroller). The slave microcontroller associated with each formation converts motion and/or proximity information to digital signals with a format common to all microcontrollers in the system. The digital signal may contain a binary signal that indicates whether or not a sensor output has exceeded a threshold. The slave microcontrollers 50*a*, 50*b*, 50*c* communicate over a wired or wireless link 51 with a central electronic system (master) 52 via the communication protocol, which may have interrupt capability. The communication may be bidirectional such that the master 52 can communicate with the various slave microcontrollers 50*a*, 50*b*, 50*c*. Each slave microcontroller 50*a*, 50*b*, 50*c* may be given a unique address to facilitate communication. The master 52 communicates information to the slave microcontrollers 50*a*, 50*b*, 50*c* such as sensor thresholds and hysteresis, power-up/down status, and sensor refractory period (the length of time after a sensor output exceeds a threshold during which the slave microcontroller ignores further excursions of the sensor outputs beyond the threshold).

In addition to communicating to the master 52, the slave microcontrollers 50*a*, 50*b*, 50*c* can provide audible and/or visible feedback to the users of the obstacle course via peripherals 53. In one implementation, each slave microcontroller 50*a*, 50*b*, 50*c* interfaces with a piezo-electric element to produce a tone when the slave microcontroller determines that a movement of a formation (or proximity of a user to a formation) exceeds a threshold. The slave microcontrollers 50*a*, 50*b*, 50*c* may also use a speaker to generate synthesized human speech to provide feedback to the user. In another implementation, electro-mechanical actuators such as motors may be used to move an artificial piece of cave flora or fauna (a bat or insect, for example) when the flora or fauna is disturbed in some way.

In addition to interfacing with the slave microcontrollers 50*a*, 50*b*, 50*c*, the previously mentioned master computer 52 may also have the task of interfacing with the operator and users of the cave obstacle course. These interfaces may be accomplished using a number of interface devices 56, including, but not limited to, optical displays 54 (character and/or graphic), keyboards 55, pointing devices, audio transducers 57, and LEDs 58. Further, the master computer 52 may be an application-specific device designed specifically for interfacing with the obstacle course, and may interface with more standard computer devices such as personal computers 59 via, for example, serial links 60.

Figure 12:
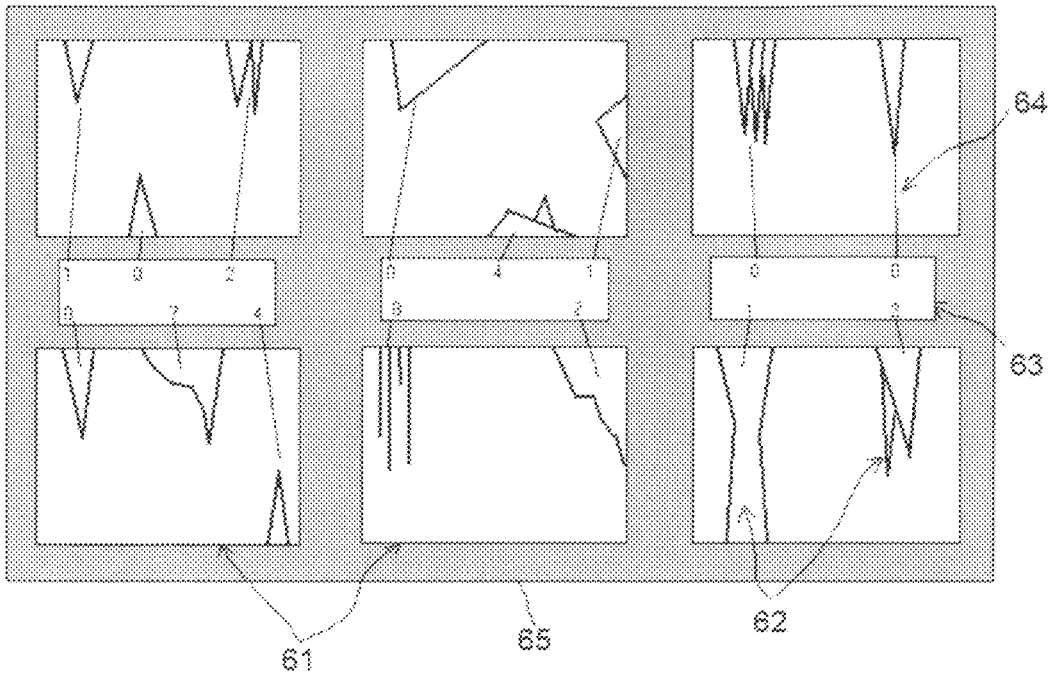
FIG. 12 is a simplified plane view of an illustrative embodiment of a map for the display of damage to each formation in each unit in accordance with certain possible aspects of the invention.

As previously discussed, one possible objective of the invention may be to provide feedback to the users of the obstacle course about how successful they are at not "damaging" (coming in contact with, or too near to) the artificial formations. Also as previously discussed, immediate audio feedback may be given when a formation is moved or encroached upon ("damaged"). This invention may provide additional forms of feedback to the user, in either immediate or delayed form. In one implementation, one of the computers 52 or 59 tracks the number of times that the user "damages" each formation, as well as the total number of "damage" to all formations. Additionally, the computer 52 or 59 may track the time that it takes the user to navigate the obstacle course. The computer 52 or 59 can also track the severity of damage to a given formation by using metrics such as degree of displacement, force applied to the formation, or time near the formation. The computer 52 or 59 can record identifying information about the user, such as name or initials. To facilitate comparison of multiple users, the computer 52 or 59 can record the aforementioned information for a multitude of users. Additionally, the computer 52 or 59 can track certain statistics, such as average damage per user, average time per user, minima and maxima, etc. The scores of individual users, as well as the aforementioned statistics, can be displayed to the users in any number of ways, and can be transmitted to other computers by various networks (for example, to computers and servers via the internet). In one implementation, shown in FIG. 12, the central computer controls a map display 65 as well as a character display (not shown). The character display shows information such as total damage, elapsed time, and name or initials of a given user. The character display also shows the aforementioned statistics, as well as various data about the state of the system. The map display 65 is composed of multiple character displays 63 as well as printed photographs 61 of each unit of the obstacle course with formations mounted in the units. The character displays 63 show numbers which indicate how many "damage" a user has done to each formation. Lines 64 are drawn from each number to the image of the associated formation. The map display 65 can also be used to display data about the status of the various sensors in the system. Alternatively, the map may instead be implemented on a graphical display, in which case the photographs of the units are displayed on the graphical display along with the numbers representing damage done to each formation.

Figure 13:
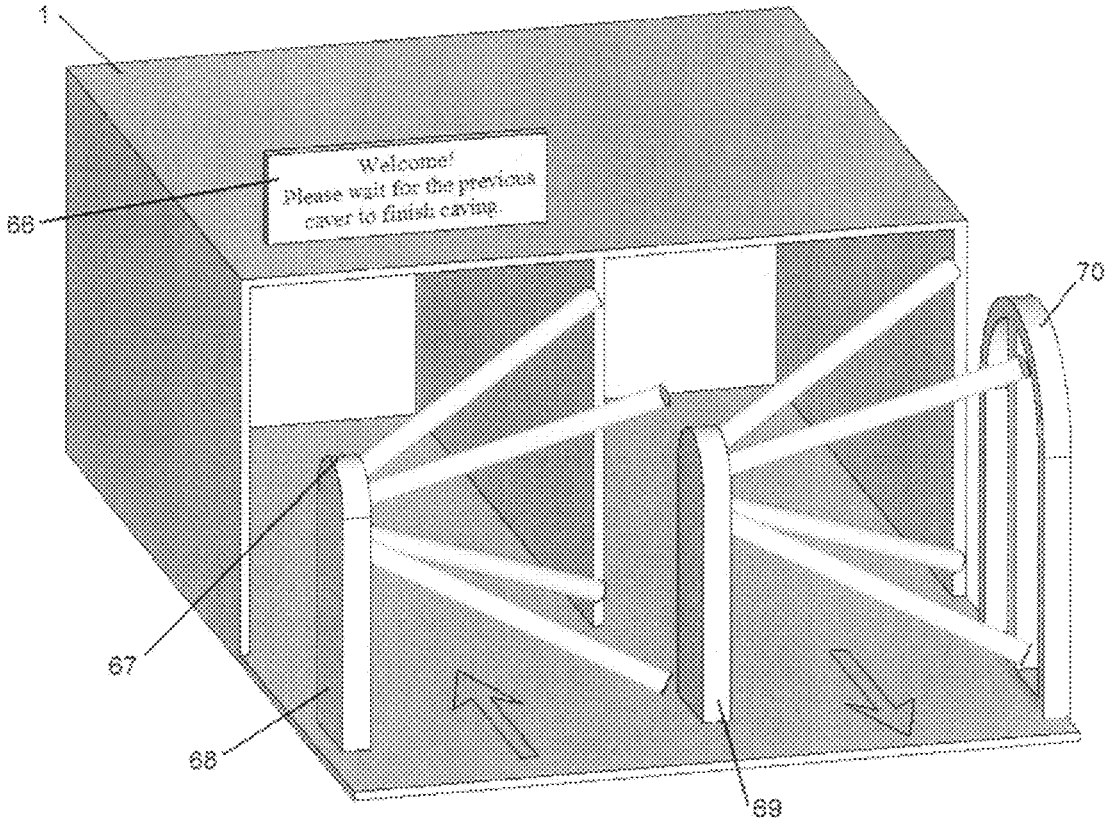
FIG. 13 is a simplified perspective (or isometric) view of an illustrative embodiment of a gating system that can be used to control the flow of users into the obstacle course in accordance with certain possible aspects of the invention.

In many circumstances, it is acceptable to have one or more human operators supervise use of the obstacle course as well control the central computer. Such operators control the flow of users into the course, enter information into the computer about the user (name, initials, etc.), start and stop timers in the computer to track each user's elapsed time, change aforementioned sensor settings via the central computer, change other settings in the central computer, and perform other tasks to aid the interface between the obstacle course and the users. However, in certain circumstances, it is advantageous to have many or all of these operator roles replaced by automation. For instance, as shown in FIG. 13, the flow of users into the course may be controlled by electro-mechanical hardware such as barriers 70 and gates or turnstiles 68 and 69 (entrance and exit) equipped with electronic latches and sensors. Such hardware may also be used to start and stop the previously mentioned timers. This hardware may also be used to collect use fees (in the form of tokens, coins, or other currency) from the users using a collection point 67. Information may be transmitted to the user via displays 66. In an alternative embodiment, the flow of users into the course may be controlled by purely electronic hardware (with human interfaces such as sensors and displays). For example, optical break-beam sensors may be used to detect entry into and exit from the course. The detection of these events may trigger audible feedback (beeps, recorded speech, speech generated by an audio codec, etc.) to the user or users to indicate the starting and stopping of timers, and/or to communicate score information to the user or users. Digital cameras may be used to record still or video images of the users, and may be interfaced with computers which perform image processing to automate the flow of users through the course.

What is claimed is:

1. Apparatus for simulating a natural cave enterable by a human user comprising:

a wall structure defining a cave-like passage through at least part of which the user must crawl;

at least one artificial speleothem mounted on the wall structure to project into the passage where it is possible for the user to contact the speleothem as the user passes through the passage, but where it is alternatively possible for the user to successfully avoid contacting the speleothem as the user passes through the passage;

means coupled to the speleothem for detecting contact of the speleothem by the user passing through the passage and for producing an electrical output signal indicative of an occurrence of said contact; and means responsive to said output signal for producing an output indication of the occurrence of said contact.

2. The apparatus defined in claim 1 wherein the wall structure is treated to give the passage an appearance of natural cave surfaces.

3. The apparatus defined in claim 1 wherein the artificial speleothem is constructed to resemble a natural speleothem selected from the group consisting of stalactites, stalagmites, cave bacon, cave popcorn, helictites, aragonite, gypsum flowers, soda straws, rafts, shields, cave pearls, flowstone, boxwork, columns, and spar.

4. The apparatus defined in claim 1 wherein the means coupled to the speleothem for detecting contact comprises:

means for detecting displacement of the speleothem as a result of said contact.

5. The apparatus defined in claim 1 wherein the means coupled to the speleothem for detecting contact comprises:

a pressure-sensitive element coupled to the speleothem.

6. The apparatus defined in claim 1 wherein the means coupled to the speleothem for detecting contact comprises:

a strain gauge coupled to the speleothem.

7. The apparatus defined in claim 1 wherein the means coupled to the speleothem for detecting contact comprises:

an accelerometer coupled to the speleothem.

8. The apparatus defined in claim 1 further comprising:

a spring operatively coupled between the speleothem and the wall structure for resiliently biasing the speleothem to remain in position relative to the wall structure.

9. The apparatus defined in claim 1 wherein the means responsive to said electrical signal comprises:

an optical display.

10. The apparatus defined in claim 9 wherein the means responsive to said electrical signal comprises:

means for causing the optical display to show how many times the user has contacted the speleothem.

11. The apparatus defined in claim 1 wherein the means responsive to said electrical signal comprises:

means for providing audible feedback to the user.

12. Apparatus for simulating a natural cave enterable by a human user comprising:

a wall structure defining a cave-like passage through at least part of which the user must crawl;

at least one artificial speleothem mounted on the wall structure to project into the passage where it is possible for the user to contact the speleothem as the user passes through the passage, but where it is alternatively possible for the user to maintain a safe distance from the speleothem as the user passes through the passage;

a proximity sensor adjacent to the speleothem for detecting an occurrence of the user being closer to the speleothem than said safe distance and for producing an electrical output signal indicative of said occurrence; and means responsive to said output signal for producing an output indication of said occurrence.

13. The apparatus defined in claim 12 wherein the proximity sensor is selected from the group consisting of optical, acoustic, audio-frequency, and capacitance-based sensors.

14. The apparatus defined in claim 12 wherein the proximity sensor is of a type selected from the group consisting of reflection-based and break-beam type sensors.

15. The apparatus defined in claim 12 wherein the proximity sensor has a mounting selected from the group consisting of in the speleothem, on the speleothem, and near the speleothem.

16. The apparatus defined in claim 12 wherein the wall structure is treated to give the passage an appearance of natural cave surfaces.

17. The apparatus defined in claim 12 wherein the artificial speleothem is constructed to resemble a natural speleothem selected from the group consisting of stalactites, stalagmites, cave bacon, cave popcorn, helictites, aragonite, gypsum flowers, soda straws, rafts, shields, cave pearls, flowstone, boxwork, columns, and spar.

18. The apparatus defined in claim 12 wherein the means responsive to said electrical signal comprises:

an optical display.

19. The apparatus defined in claim 18 wherein the means responsive to said electrical signal comprises:

means for causing the optical display to show how many times said output signal indicative of said occurrence has been produced.

20. The apparatus defined in claim 12 wherein said means responsive to said electrical signal comprises:

means for providing audible feedback to the user.

* * * * *